US006058837A

United States Patent [19]

Kamoda

[11] Patent Number: 6,058,837

[45] Date of Patent: May 9, 2000

[54] INKING DEVICE FOR PRINTING MACHINE

[75] Inventor: Hiroyoshi Kamoda, Higashikatsushika-gun, Japan

[73] Assignee: Komori Corporation, Tokyo, Japan

[21] Appl. No.: 09/128,975

[22] Filed: Aug. 4, 1998

[30] Foreign Application Priority Data

Aug. 8, 1997 [JP] Japan ..... 9-214368

[51] Int. Cl.[7] ..... B41F 31/12; B41F 31/34

[52] U.S. Cl. ..... 101/352.03; 101/352.04

[58] Field of Search ..... 101/352.01, 352.02, 101/352.03, 352.04, 349.1, 351.1, 351.2, 351.3, 247, 207, 208, 209, 210; 118/258

[56] References Cited

U.S. PATENT DOCUMENTS

| | | | |
|---|---|---|---|
| 1,524,816 | 2/1925 | Dalby | 101/352.04 |
| 3,448,686 | 6/1969 | Bohman . | |
| 5,230,284 | 7/1993 | Kelm | 101/247 |

FOREIGN PATENT DOCUMENTS

| | | |
|---|---|---|
| 0105476 | 4/1984 | European Pat. Off. . |
| 0437230A2 | 7/1991 | European Pat. Off. . |
| 1949092 | 4/1970 | Germany . |
| 63251237 | 10/1988 | Japan . |
| 3-207653 | 9/1991 | Japan . |
| 7-34670 Y2 | 8/1995 | Japan . |

*Primary Examiner*—J. Reed Fisher

[57] ABSTRACT

An inking device for a printing machine, which has both a nip pressure adjusting mechanism, adjustable from the outside during the running of the machine, and a follow-up mechanism of a nip pressure to a movement of a plate cylinder and increase a degree of freedom in handling each member for the inking device enable the setting thereof to be easier. The inking device is equipped with two supporting levers 14 which rotatably supports the second and third form rollers 13*b* and 13*c* and are usually biased by compression coil springs 23 to push the second and third form rollers 13*b* and 13*c* against a plate cylinder 4, and two rolling member supporting levers 25 supporting a bearing roller 27 to contact a roller-lifting cam 7 and another bearing roller 27 to contact a plate cylinder follow-up cam 6 supported by the second eccentric bearing 2, wherein each of the supporting levers 14 and each of the rolling member supporting levers 25 are interconnected by a screw rod 29. A pitch of a screw to be screwed into the supporting lever 14 and a pitch of a screw to be screwed into the rolling member supporting lever 25 are different from each other so that a relative position between the supporting lever 14 and the rolling member supporting levers 25 is made alterable.

10 Claims, 7 Drawing Sheets

INKING DEVICE FOR PRINTING MACHINE

BACKGROUND OF THE INVENTION (1) Field of the Invention

The present invention relates to an inking device for a printing machine, which has both a follow-up mechanism of a nip pressure to the shift of a plate cylinder and a nip pressure adjusting mechanism operable from the outside while the machine operates.

(2) Description of the Related Art

Heretofore, an inking device mounted on a printing machine, such as a rotary printing machine, is provided with an ink fountain and a number of rollers. The ink reserved in the ink fountain, is taken up by rotating the roller to adhere the ink to the surface of the roller in the state of an ink film. Subsequently, this ink film is uniformed and kneaded in various directions while transferred among a number of rollers, and then it is supplied to a plate surface on a plate cylinder by a form roller.

In such an inking device, there is a fear that a contact pressure between the form roller and the print surface, viz. a nip pressure is varied owing to the change in the diameter of the form roller by the thermal expansion and abrasion thereof, the finish state of the plate cylinder, and the like. Since the nip pressure largely influences the quality of prints, the nip pressure is adjusted in a printing preparation step or at the time of printing by providing the inking device with a nip pressure adjusting device.

An example of such a nip pressure adjusting device is disclosed in Japanese Utility Model Publication No. 34670/1995 suggested by the applicant of the present invention. In this device, as shown in FIG. 6, when a drive piece 100 is rotated, for example, clockwise from the outside while the machine is running, a drive rod 103 rotates clockwise via a control rod 101 and a universal joint 102. At this time, a pull rod 105 is pulled into a nut 104 at the right end of the drive rod 103 by its screw action, and a lever 106 rotates counterclockwise to thus reduce the nip pressure (a contact pressure between a form roller 107 and a plate cylinder 108). On the contrary, when the drive piece 100 is rotated counterclockwise, the pull rod 105 is delivered from the nut 104 and hence the lever 106 rotates clockwise to increase the nip pressure.

On the other hand, at the time of roller-lifting (which separates the form roller 107 from the plate cylinder 108 temporarily), the lever 106 rotates counterclockwise. In this case, there is, deformed under compression, a compression coil spring 109 which is wound around the pull rod 105 to push the form roller 107 against the plate cylinder 108 through the lever 106, and the drive rod 103 slides into the universal joint 102 to allow the lever 106 to rotate. The above description is made with regard to the lever 106 on the upper and this side in the figure. Now, referring to a lever 106 on the lower and this side (this is similar to the lever 106 on the upper and far side), obviously it is slightly different from the above lever 106 in that the pull rod 105 is replaced by a push rod 110 as a constitution of the lever angle changing means and the position of the compression coil spring 109 is altered to thereby become changed in the direction of action, because the rotational direction of the lever for increasing/decreasing a nip pressure is opposite to that of the above case. The numerals 111 and 112 in FIG. 6 denote an aggregation rubber barrel and ink rollers, respectively.

In the printing machine, when the print surface is mounted on the plate cylinder, it likely occurs that the print surface gets slightly twisted in relation to the plate cylinder and both the right and left ends of the print surface are twisted in the opposite circumferential directions of the plate cylinder, thereby making the right-and-left register inconsistent. To cope with this, a so-called twist adjustment is conducted in such a way that the inconsistent register is changed proper by shifting an eccentric bearing which rotatably supports the rotational shaft of the plate cylinder on the frame of the printing machine.

However, in a conventional nip pressure adjusting device, since the twist adjustment of the plate cylinder changes the nip pressure already adjusted, it requires to readjust the nip pressure. Accordingly, the applicant of the present invention has before presented the inking device in Japanese Laid-Open Patent Publication No. HEI 3-207653 wherein a nip pressure remains unchanged even after a twist adjustment of a plate cylinder to dispense with a readjustment of a nip pressure.

In this inking device, as shown in FIG. 7, in which a cam driving means is not shown, when not in printing operation, shifts a cam 123 in relation to a plate cylinder 122 in such a way that the driving means pushes a cam-follower 121 upwardly and away from the plate cylinder 122 while resisting a biasing force caused by a compression coil spring 120. Hence, a form roller 124 is parted from the plate cylinder 122 to become non-contact. In printing operation, the cam driving means shifts the cam 123 in relation to the plate cylinder 122 so that the form roller 124 may be pushed against the plate cylinder 122 to become firmly in contact therewith by a biasing force of the compression coil spring 120.

At the time of printing, when a rotary lever 125 is moved by an adjusting screw 126, the position of the cam follower 121 is changed in relation to a roller arm 127 because the cam follower 121 is eccentrically supported on the supporting axis of the rotary lever 125. Accordingly, the relative rotational position of the cam follower 121 to the form roller 124 supported by the roller arm 127 is changed. Hence, the form roller 124 is moved in the radial direction of the plate cylinder 122 and consequently a pressure of the form roller 124, applied to the print surface (a nip pressure), is changed.

When a twist adjustment is conducted, since the cam 123 mounted on the plate cylinder 122 is moved together with the cam 122, the cam follower 121 pushed against the cam 123 is also moved simultaneously. Accordingly, before and after the twist adjustment, the relative positional relation between the form roller 124 and the plate cylinder 122 is not altered, and then the biasing pressure, viz. the nip pressure therebetween remains unchanged.

However, in the nip pressure adjusting device, as described above in FIG. 6, it is provided with the nip pressure adjusting mechanism that can be controlled from the outside when the machine is in running, but it is not provided with any follow-up mechanism for a nip pressure capable of coping with a movement of the plate cylinder. Hence there is a problem that a nip pressure is changed when the plate cylinder is moved. In the inking device in FIG. 7, on the contrary, it bears the follow-up mechanism for a nip pressure for coping with a movement of the plate cylinder, but dose not bear any nip pressure adjusting mechanism that can be controlled from the outside when the machine is in running and accordingly this causes such a problem that quality of print is not improved sufficiently.

Accordingly, it is strongly required to develop an inking device which has both a nip pressure adjusting mechanism that can be controlled from the outside during the running of the machine and a follow-up mechanism of a nip pressure capable of coping with a movement of a plate cylinder, however, it has not been realized from such a reason that any form roller is positioned within an arrangement of rollers and hence an adjusting direction of a nip pressure adjusting mechanism is restricted, and the like. Taking the inking device in FIG. 7 as an example, when it is intended to dispose the knob of an adjusting screw 126 to shift the eccentric rotary lever 125 in the outside, a supporting point and an adjusting direction of the eccentric lever is restricted so that handling of each member becomes very difficult.

An object of the present invention is to provide an inking device for a printing machine, which has both a nip pressure adjusting mechanism that can be controlled from the outside during the running of the machine and a follow-up mechanism of a nip pressure capable of coping with a movement of a plate cylinder, and wherein there is a degree of freedom in handling each member for the inking device and the inking device is easily set.

SUMMARY OF THE INVENTION

An inking device for a printing machine according to the present invention which can solve the above problems is constituted as follows:

(1) An inking device for a printing machine which comprises a first lever for detachably supporting a form roller to a plate cylinder, a second lever for supporting a cam follower that contacts a plate cylinder follow-up cam supported on the plate cylinder side and for moving the form roller to separate the form roller from the plate cylinder by a roller-lifting cam, a biasing means for pressing the form roller against the plate cylinder, and an adjusting means which enables adjusting a relative position between the first lever and second lever by an operating section.

(2) The inking device for the printing machine according to the above-mentioned paragraph (1), wherein the adjusting means is a screw rod for interconnecting the first lever and the second lever, and a screw to be screwed into a threaded bore of the first lever and another screw to be screwed into a threaded bore of the second lever are different from each other.

(3) The inking device for the printing machine according to the above-mentioned paragraph (2), wherein the screw rod is extended up to the end surface of a frame, and a handle is supported on the end of the screw rod on the side of the frame end surface.

(4) The inking device for the printing machine according to the above-mentioned paragraph (3), wherein the screw rod comprises a plurality of rods which are interconnected via a universal joint.

(5) The inking device for the printing machine according to the above-mentioned paragraph (1), wherein the adjusting means is a screw rod for interconnecting the first lever and a second lever, the screw rod being screwed into a threaded bore of the first lever and supported by the second lever in such a way as to be freely rotatable and as to restrict its movement in an axial direction.

(6) The inking device for the printing machine according to the above-mentioned paragraph (1), wherein the first and second levers are coaxially and swingably supported.

(7) The inking device for the printing machine according to the above-mentioned paragraph (6), wherein the first and second levers are adjacently supported coaxially with oscillating roller which the form roller contact rotatably.

(8) The inking device for the printing machine according to the above-mentioned paragraph (1), wherein the form roller is supported by the first lever via a holder, and the end of the holder is eccentrically supported by the first lever.

According to an inking device for a printing machine having the above constitution, the adjusting means changes the relative position between the first and second levers to thereby vary a nip pressure of the form roller to the plate cylinder.

Also, the relative position between the first and second levers can be varied minutely by a rotation of the screw rod on which a screw on the first lever side and the other screw on the second lever side are formed so as to differ from each other.

DETAILED DESCRIPTION OF THE PREFERRED EMBODIMENTS

Figure 1:
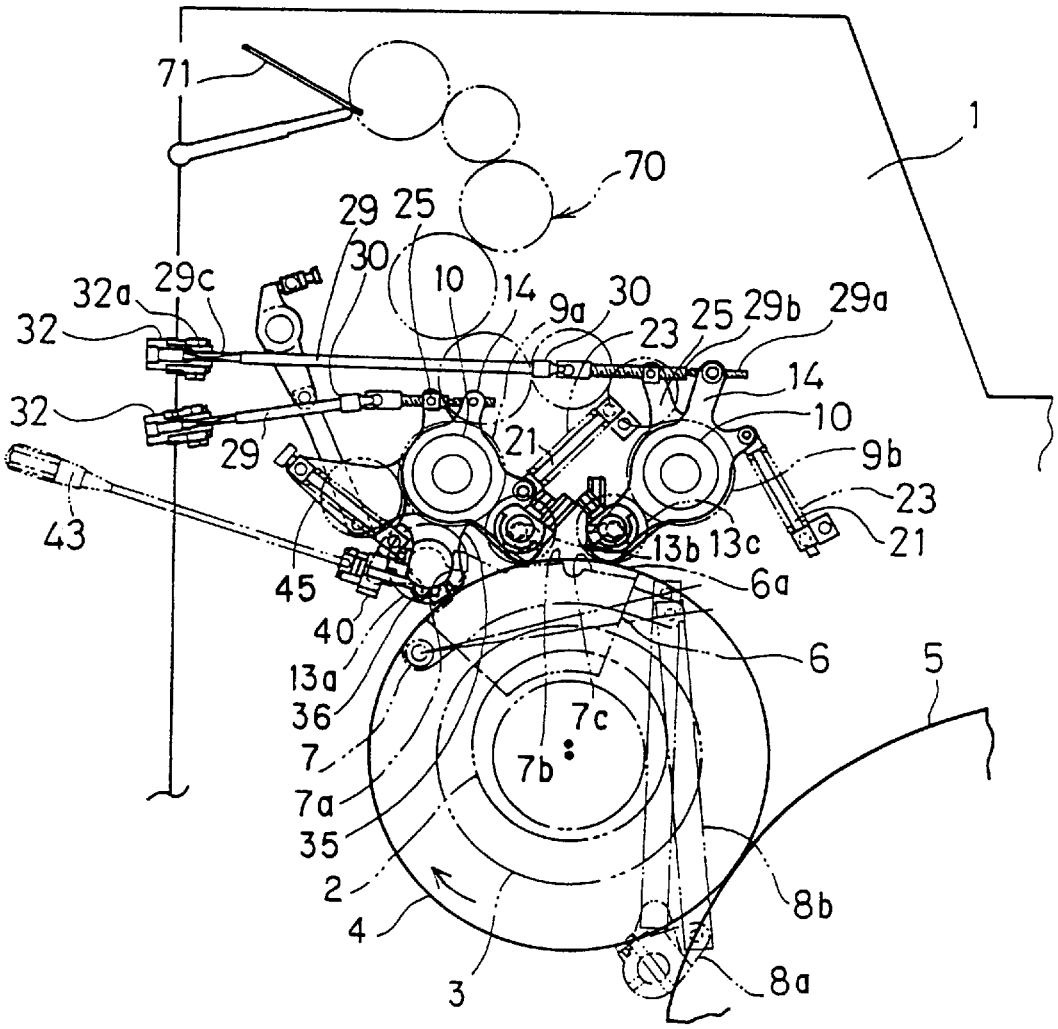
FIG. 1 shows a side view of a main part of an inking device relating to an embodiment of the present invention.
Figure 2:
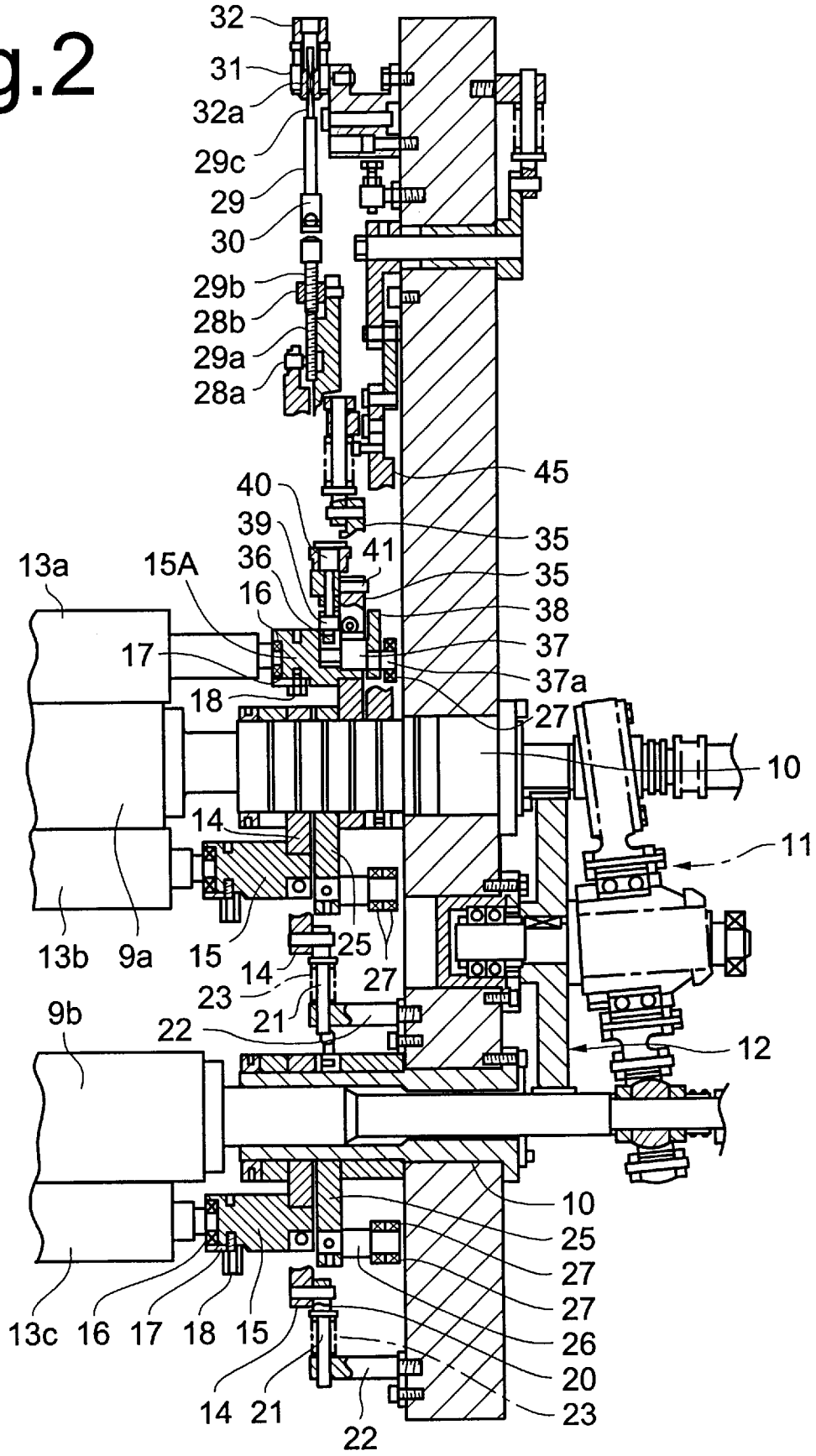
FIG. 2 shows a cross sectional plan view of the main part of the inking device relating to the embodiment of the present invention.
Figure 3:
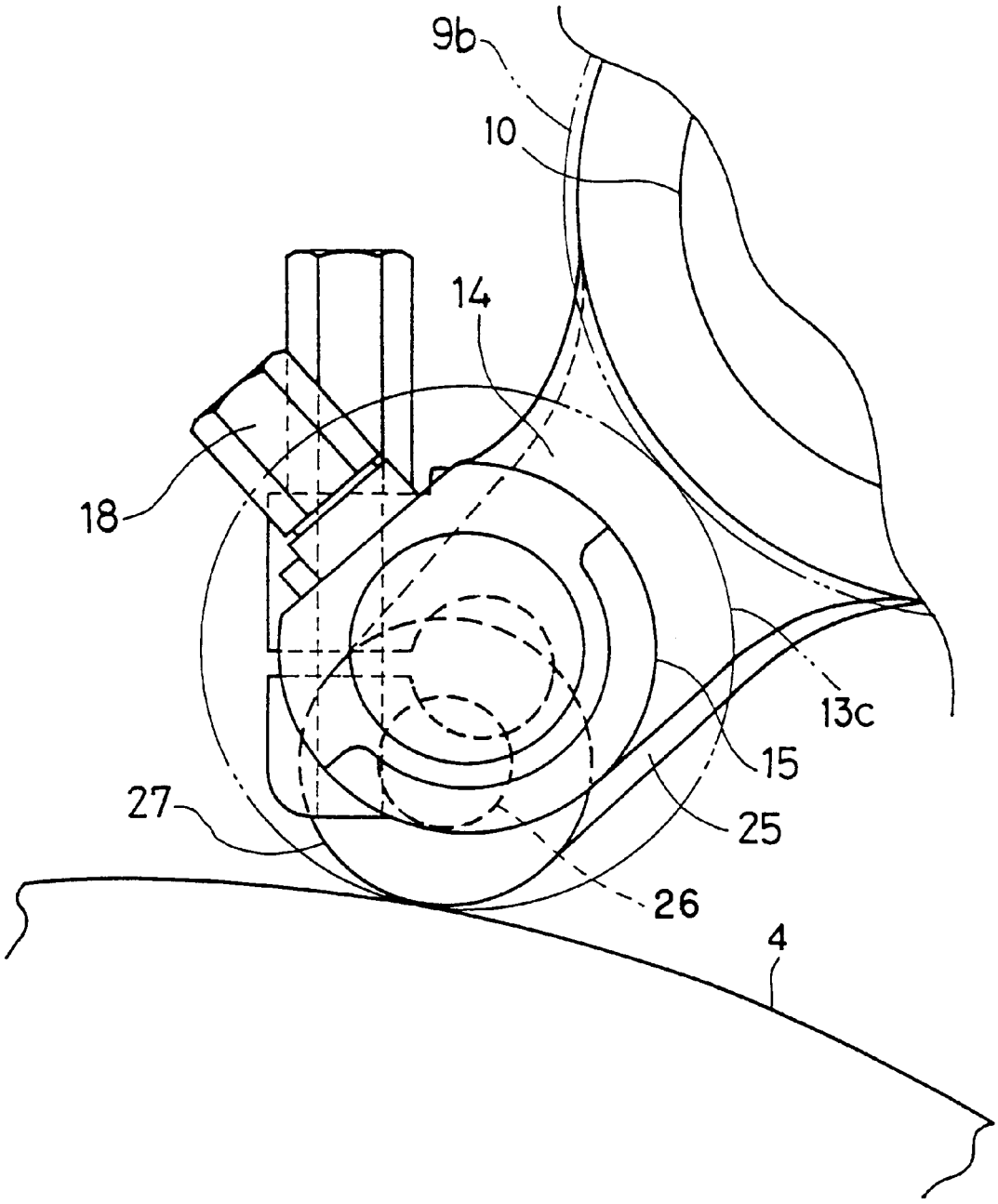
FIG. 3 shows an enlarged side view of the third form roller of the inking device relating to the embodiment of the present invention.
Figure 4:
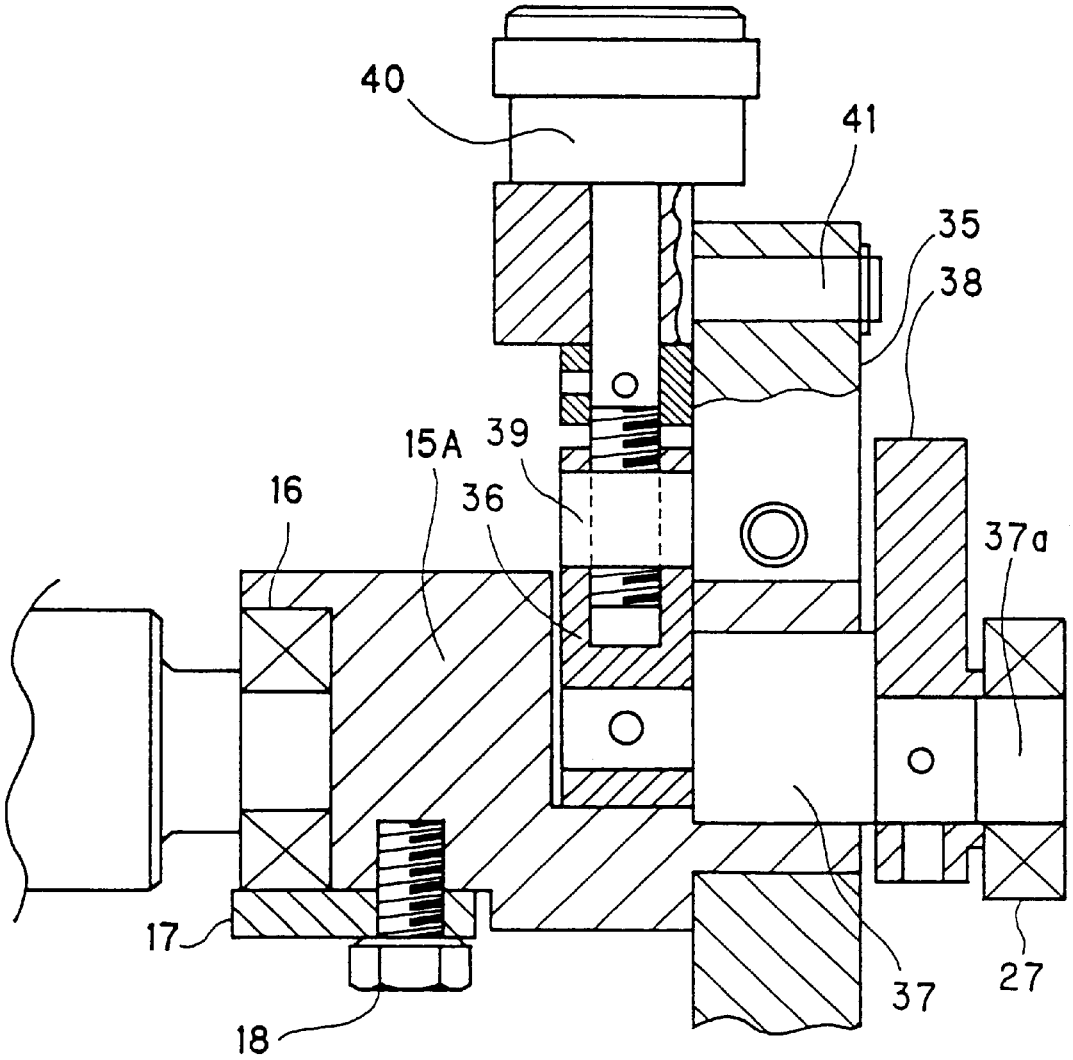
FIG. 4 shows an enlarged cross sectional plan view of the first form roller of the inking device relating to the embodiment of the present invention.
Figure 5:
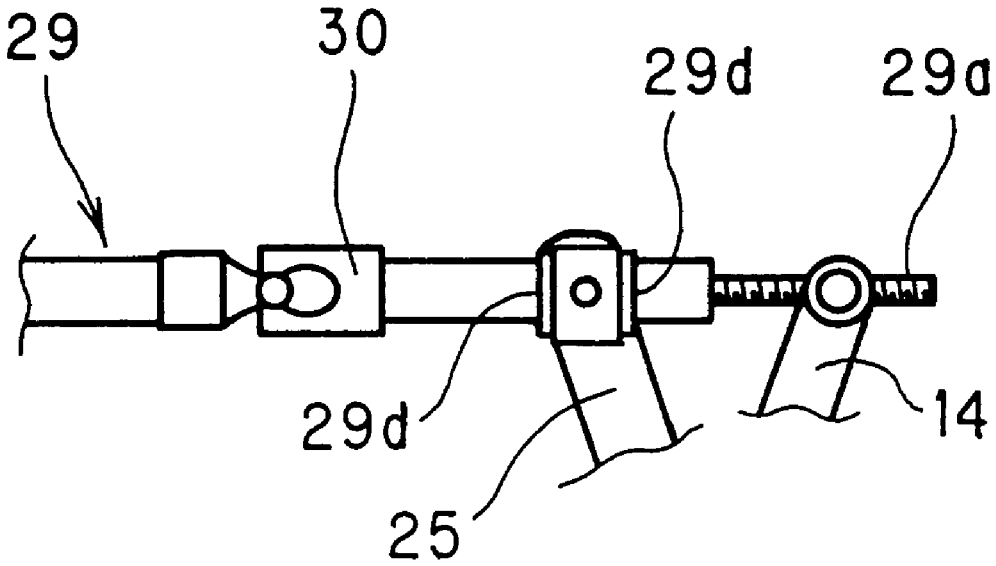
FIG. 5 shows an enlarged side view of a modified example of a screw rod.
Figure 6:
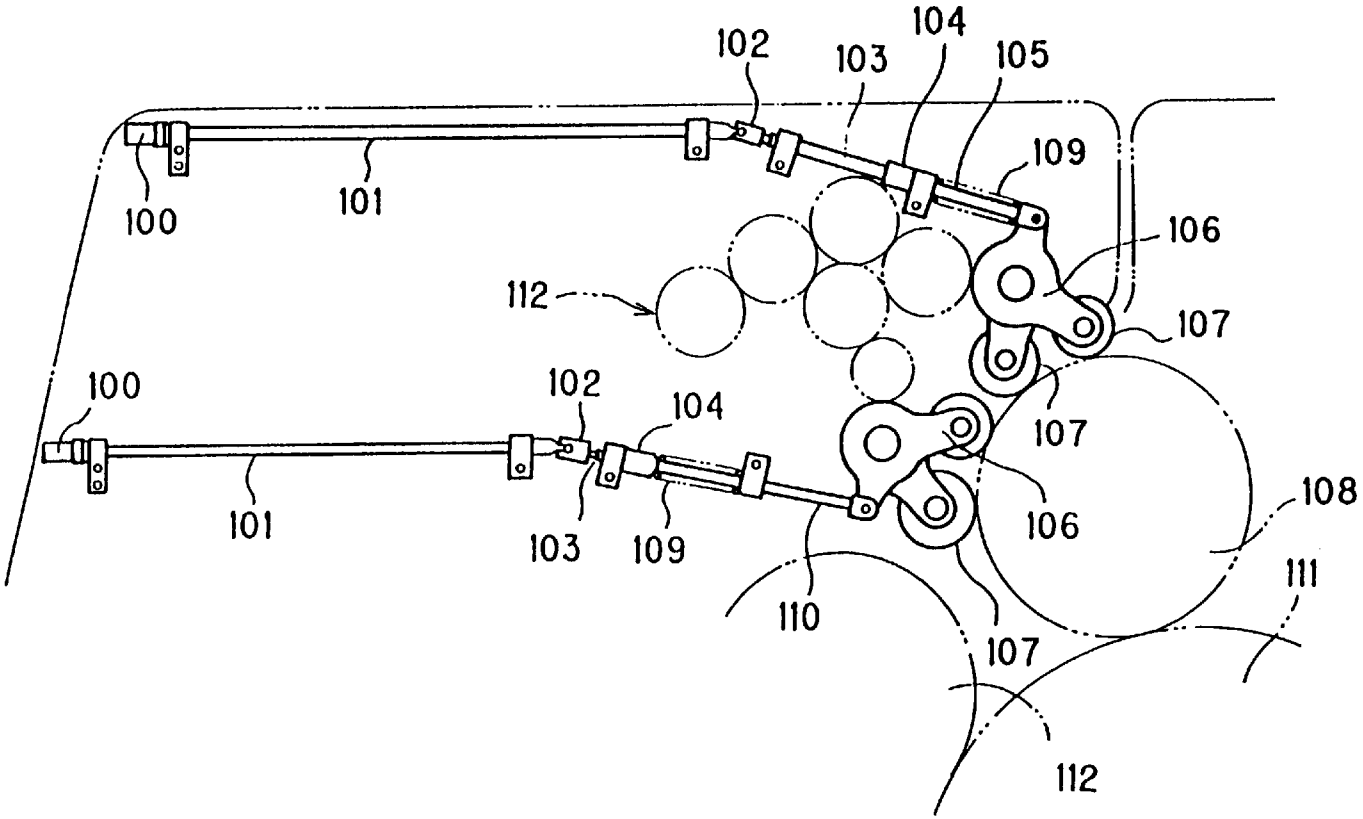
Fig. 6 Related Art
FIG. 6 shows a side view of a conventional nip pressure adjusting device.

FIG. 1 is a side view showing a main part of an inking device relating to an embodiment of the present invention, FIG. 2 is a cross sectional plan view showing the main part of the inking device relating to the embodiment of the present invention, FIG. 3 is an enlarged side view showing the third form roller of the inking device relating to the embodiment of the present invention, FIG. 4 is an enlarged cross sectional plan view showing the first form roller of an inking device relating to the embodiment of the present invention, and FIG. 5 is an enlarged side view showing a modified example of a screw rod.

As shown in FIGS. 1 and 2, a plate cylinder (a number barrel etc.) 4 is rotatably and axially supported by a couple of right-and-left frames via the first and second eccentric bearings 2 and 3 and a contact pressure between a plate cylinder 4 and pushing barrel 5 is adjusted by shifting a pair of the first right-and-left eccentric bearings 2, in such a situation, a twist adjustment is conducted by shifting either of the second right-and-left eccentric bearings 3.

A plate cylinder follow-up cam 6 is mounted on the second eccentric bearing 3 so that a circular cam surface 6*a* may be in conformity with the outer periphery of the plate cylinder 4, a roller-lifting cam 7 (a cam adapted to attach/detach the first to third form rollers 13*a* to 13*c* that will be described later.) having three cam surfaces 7*a*, 7*b*and 7*c* is swingably supported by the frames 1 as it adjoins the plate cylinder follow-up cam 6, and it is so formed as to enable attaching/detaching the first to third form rollers 13*a* to 13*c* to/from the plate cylinder 4 by the driving means of a lever 8*a*, rod 8*b*, attaching/detaching cylinder (not illustrated), etc.

Above the plate cylinder 4, both the axial ends of each of the first and second swing rollers 9*a* and 9*b*, positioned in the end portion of the inking device, are rotatably supported by the frames 1 via the bearings 10, and the swing rollers 9*a* and 9*b* are provided with a swinging mechanism 11 and each adapted to be reciprocated in the axial direction in the prescribed cycles while drivingly rotated by a driving means 12.

The above mentioned first and second form rollers 13*a* and 13*b* rotatably contact the first swing roller 9*a*, and similarly the third form roller 13*c* rotatably contacts the second swing roller 9*b*.

That is to say, as illustrated in FIG. 3, roller supporting levers 14, as the first level, are rotatably mounted on the bearings 10 of the first and second swing rollers 9*a* and 9*b*, and the second and third form rollers 13*b* and 13*c* are each supported by one end side of the roller supporting levers 14 via holders 15 respectively. Bearings 16 to support the axial ends of the second and third form rollers 13*b* and 13*c* are fixed to one ends of the holders 15 by bolts 18 via holding plates 17, and furthermore, the other ends of the holders 15 are eccentrically fixed to the roller supporting levers 14 using split clamps, hence, each contact pressure of the first and second form rollers 13*a* and 13*b* applied to the first and second swing rollers 9*a* and 9*b* is made adjustable by unclamping the split clamps followed by shifting the holders 15.

Meanwhile, each one end side of a first spring bearing member 20 and a guide rod 21 is rotatably connected to the other end side of each roller supporting lever 14, and each second spring bearing 22 is slidably engaged with the guide rod 14 on the other end side thereof. The second spring bearing member 22 is rotatably mounted on the frame 1, and a compression coil spring 23 is wound around the guide rod 21 between the first and second spring bearing member 20 and 22. Accordingly, a rotating force round each bearing 10 supplied to the roller supporting lever 14 by a biasing force of the compression coil spring 23 and the rotating force pushes the first and second form roller 13*b* and 13*c* against the plate cylinder 4.

Each rolling member supporting lever 25, as the second lever, is rotatably mounted on each bearing 10 of the first and second swing rollers 9*a* and 9*b*, and two rows of bearing rollers (cam followers) 27 are mounted on one end side of the rolling member supporting lever 25 by means of a pin 26. The inner bearing roller 27 and outer bearing roller 27 are brought into contact with the cam surface 6*a* of the above described plate cylinder follow-up cam 6 and the cam surfaces 7*b* and 7*c* of the roller-lifting cam 7 as defined above, respectively.

The other end sides of the roller supporting lever 14 and rolling member supporting lever 25 are connected to each other through the intermediary of a screw rod 29 as a adjusting means using pins 28*a* and 28*b*. As for a screw portion 29*a* of the screw rod 29, which is screwed into the pin 28*a* on the roller supporting lever 14, the pitch thereof is set as P=1, for example, meanwhile, as for a screw portion 29*b* of the screw rod 29, which is screwed into the pin 28*b* on the rolling member supporting lever 25, the pitch thereof is set as P=1.5, for example.

The screw rod 29 is extended to the end surface of the frame via an universal joint 30, and a square rod portion 29*c* of the tip end thereof is slidably and axially inserted into a square hole 32*a* of a handle 32 connected to the frame 1 by a pin 31. The connection of the square rod portion 29*c* and square hole 32*a* allows the screw rod 29 to move forward and backward when the second and third form roller 13*b* and 13*c* are attached or detached by the roller-lifting cam 7.

Furthermore, another roller supporting lever 35 is rotatably mounted on the bearing 10 of the first swing roller 9*a* as it adjoins the rolling member supporting lever 25, the first form roller 13*a* rotatably supported by the tip end of the roller supporting lever 35 via a holder 15A. Each bearing 16, for supporting the axial end of the first form roller 13*a*, is fixed to one end side of the holder 15A by bolts 18 via a holding plate 17, the other end side of the holder 15A is eccentrically fixed to the roller supporting lever 35 using a split clamp, and hence a contact pressure of the first form rollers 13*c* applied to the first swing rollers 9*c* is made adjustable by unclamping the split clamps followed by shifting the holders 15A.

As shown in FIG. 4, a rotational shaft 37 connected, not rotatably, to a rotary lever 36 is rotatably engaged with the holder 15A, the shaft axis of the rotational shaft 37 is deviated from that of the first form roller 13*a*. A plate cam 38 (cam follower) and bearing rollers 27 are mounted on an eccentric shaft 37a on the outer end side of the rotational shaft 37. The inner plate cam 38 and outer bearing roller 27 are brought into contact with the cam surface 6a of the plate cylinder follow-up cam 6 as mentioned above and the cam surface 7*a* of the roller-lifting cam 7 as mentioned likewise, respectively.

A pin 39, within which a female screw is formed, is engaged with the tip end portion of the rotational lever 36 rotatably engaged with the holder 15A. On the other hand, an adjusting screw 40, screwed into the pin 39, is rotatably mounted on the roller supporting lever 35 via a pin 41 engaged with the roller supporting lever 35.

Figure 7:
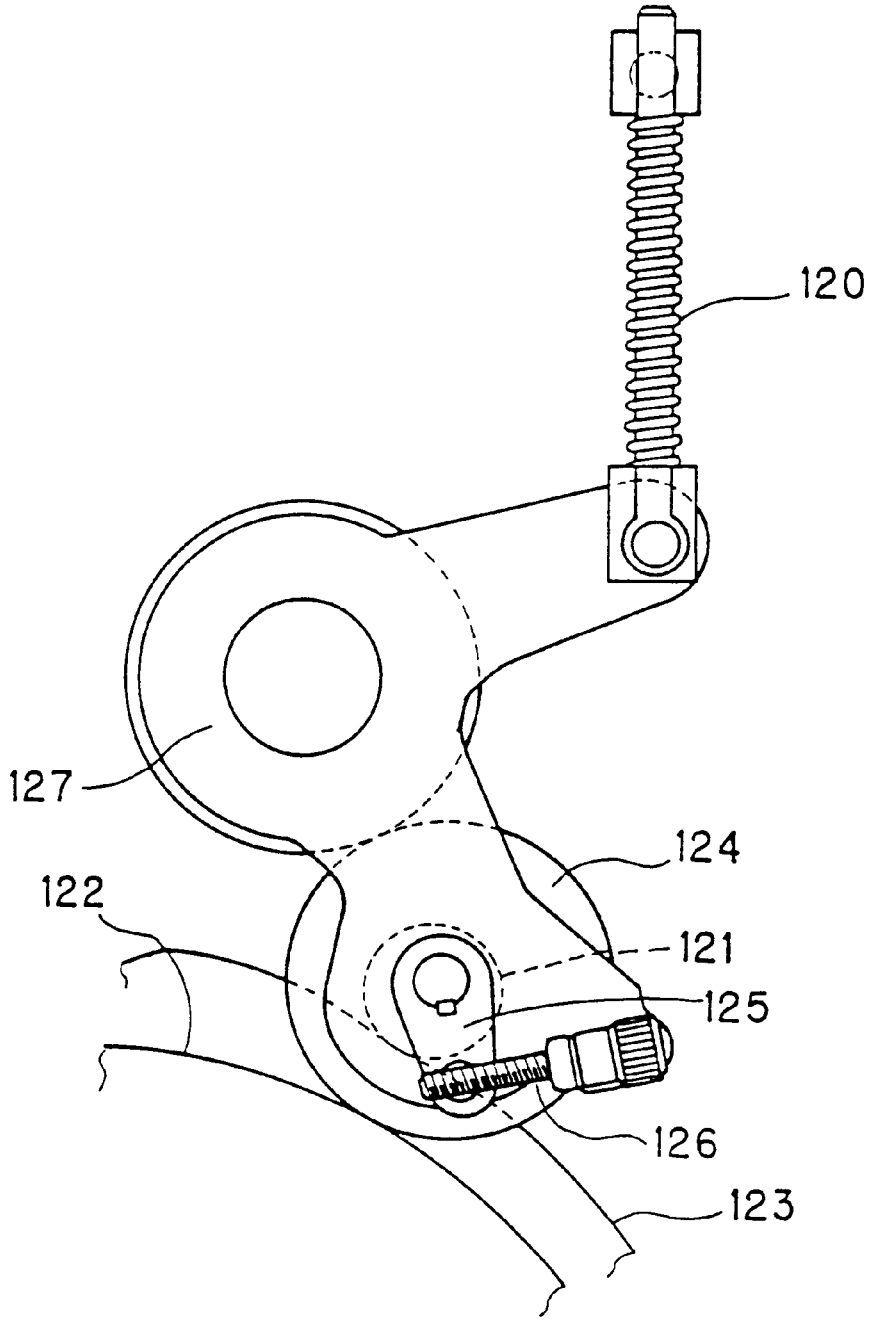
Fig. 7 Related Art
FIG. 7 shows a side view of a conventional follow-up mechanism of a nip pressure when a plate cylinder is moved.

Accordingly, when the adjusting screw 40 is rotated directly or using a screw driver 43 (referring to FIG. 1) etc., the pin 39 moves forward or backward to the adjusting screw 40 so that the rotational lever 36 and rotational shaft 37 rotates in relation to the holder 15A. As a result, the shaft axis of the plate cam 38 mounted on the rotational shaft 37 moves on the circular arc around the shaft axis of the holder 15, and the shaft axis of the plate cam 38 is relatively shifted in relation to the shaft axis of the first form roller 13*a*. The position of the first form roller 13*a*, in relation to the plate cylinder 4 is shifted into the radial direction of the plate cylinder 4 and thereby a nip pressure can to be adjusted. In FIG. 7, the numerals 70 and 71 are each to denote ink rollers and an ink fountain, respectively.

As constituted above, while printing is not conducted, the roller-lifting cam 7 is driven by the driving means of the lever 8*a*, rod 8*b* and attaching/detaching means (not illustrated) to be swingably moved upward. Thereby, the three bearing rollers 27 make contact with the three cam surfaces 7*a*, 7*b* and 7*c* of the roller-lifting cam, and shifted while resisting the biasing forces of the compression coil springs 29 and 63, together with the rolling member supporting lever 24 and roller supporting level 14, as it is lifted from the plate cylinder 4. Hence, the first to third rollers 13a to 13c are separated from the plate cylinder 4 to take a non-contact form.

At the time of printing, when the screw rod 29 is rotated by operating the handle 32 from the outside, since the pitch (P=1) of the screw portion 29*a* of the screw rod 29, which is screwed into the pin 28*a* on the roller supporting lever 14, is different from the pitch (P=1.5) of the screw portion 29b screwed into the pin 28*b* on the rolling member supporting lever 25, the relative position (phase) of both the levers 14 and 25 is changed. At this time, the bearing roller 27 of the rolling member supporting lever 25 is situated on the cam surface 6*a* of the plate cylinder follow-up cam 6, on the other hand, the phase of the roller supporting lever 14 is varied more largely than that of the rolling member supporting lever 25, consequently, it changes biasing pressures (nip pressures) of the second and third form rollers 13*b* and 13*c* against the printing plate of the plate cylinder 4 are altered. Meanwhile, a nip pressure of the first form roller 13*a* gets adjustable by rotating the adjusting screw directly or using the screw driver 43 etc. as described before to thereby alter the position of the third form roller 13*c* in the radial direction of the plate cylinder 4 through a movement of the plate cam 38.

When a twist adjustment of the plate cylinder 4 is conducted by shifting either of the second right-and-left eccentric bearings, since the printing follow-up cam 6 mounted on the second eccentric bearing 3 moves together with the plate cylinder 4, the two bearing rollers 27 and the plate cam 38, which are pushed against the cam surface 6*a* of the printing follow-up cam 6, are also moved simultaneously. Accordingly, before and after the twist adjustment, the positional relation between the first to third form rollers 13*a* to 13*c* and the plate cylinder 4 is not altered and the nip pressure remains unchanged.

Like the above, in the embodiment, as a nip pressure adjusting mechanism of the second and third form roller 13*b* and 13*c* positioned inside the machine and within an arrangement of rollers, the double lever mechanism is employed, and hence there is a degree of freedom in handling the screw rod 29 and the preparation using the same becomes easier. Also, there is an advantage that minute adjustments can be made because of utilizing the differential screws formed on the screw rod 29.

The present invention is never limited to the above embodiments, needless to say, any various changes, modifications and alterations of the embodiments are possible as far as they do not depart from the spirit and scope of the invention. For example, a cam follower that makes contact with the plate cylinder and roller-lifting cam may be formed in one united body. It is possible that a pitch of a screw portion screwed into the roller supporting lever side of the screw rod is the same as that of another screw portion screwed into the rolling member supporting lever and these screws are screwed in the opposite directions each other to form a relation of reverse screws. With regard to the screw rod 29, it is possible that, concerning the roller supporting lever 14, the screw portion 29*a* is engaged therewith in the same manner as that of the embodiment, and as to the rolling member supporting lever 25, the screw rod 29 is freely rotated therethrough and supported thereby as its axial movement is restricted. In FIG. 5, the symbol 29*d* denotes its disk fixed to the screw rod 29 for restricting the axial movement.

According to an inking device for a printing machine of the present invention, the inking device for a printing machine comprises: a first lever which rotatably supports a form roller and resiliently biased to push the form roller against a plate cylinder; a second lever provided with a cam follower to contact a roller-lifting cam and another cam follower to contact a plate cylinder follow-up cam supported on the plate cylinder side, there is provided an adjusting means which adjusts a relative position between the first and second levers from an operating portion, and thereby the inking device has both a nip pressure adjusting mechanism controlled from the outside during the running of the machine and a follow-up mechanism of a nip pressure that copes with a movement of a plate cylinder and bring about a degree of freedom in handling each member for the inking device so as to enable the setting thereof to be easier.

The adjusting means is a screw rod for connecting the first and second levers, and a screw to be screwed into a threaded bore of the first lever and another screw to be screwed into a threaded bore of the second lever are different from each other so that a relative position of the first and second levers is able to be altered minutely.

What is claimed is:

1. An inking device for a printing machine having a plate cylinder and a form roller supported by a frame, comprising:

moving means for moving a rotational axis of the plate cylinder;

a first lever adapted to support the form roller;

a follow-up cam supported by a member supporting the plate cylinder, said follow-up cam maintaining a position relative to the plate cylinder even after moving the rotational axis of the plate cylinder;

a second lever adapted to support a cam follower that engages said follow-up cam such that a nip pressure applied to the plate cylinder by the form roller is maintained even after moving the rotational axis of the plate cylinder;

biasing means for pressing the form roller against the plate cylinder;

adjusting means for adjusting a relative position between the first lever and the second lever to adjust the nip pressure; and an operating section for controlling said adjusting means, said operating section being provided in a vicinity of the frame such that the nip pressure can be adjusted from outside the frame.

2. The inking device for the printing machine according to claim 1, wherein said adjusting means is a screw rod for interconnecting said first lever and said second lever, and a pitch of a first screw screwed into a threaded bore of said first lever is different from a pitch of a second screw screwed into a threaded bore of said second lever.

3. The inking device for the printing machine according to claim 2, wherein said screw rod extends to an end surface of the frame, and said operating section includes a handle supported on the end of the screw rod on the side of the frame end surface.

4. The inking device for the printing machine according to claim 3, wherein said screw rod includes a plurality of rods interconnected via a universal joint.

5. The inking device for the printing machine according to claim 1, wherein said adjusting means is a screw rod for interconnecting said first lever and said second lever, said screw rod being screwed into a threaded bore of said first lever and supported by said second lever in such a way as to be freely rotatable and as to restrict a movement thereof in an axial direction.

6. The inking device for the printing machine according to claim 1, wherein a rotational axis of said first lever and a rotational axis of said second lever are coaxially supported and said first and second levers are swingably supported with respect to the frame.

7. The inking device for the printing machine according to claim 6, further comprising:

an oscillating roller in contact with the form roller, wherein said first lever and said second lever are provided adjacently with respect to one another and supported coaxially by a rotational shaft of said oscillating roller.

8. The inking device for the printing machine according to claim 1, wherein the form roller is supported by said first lever via a holder, and one end of the holder is eccentrically supported, with respect to a rotational axis of the form roller, by said first lever.

9. The inking device for the printing machine according to claim 1, further comprising:

a roller-lifting cam that moves between a first position and a second position; and moving means for selectively moving said roller lifting cam between said first and second positions, wherein said cam follower makes contact with said roller lifting cam such that the form roller makes contact with the plate cylinder when said roller-lifting cam is in the first position and moves the form roller away from the plate cylinder when said roller-lifting cam is in the second position.

10. The inking device for the printing machine according to claim 1, wherein said biasing means applies biasing force to said first lever to urge the form roller towards the plate cylinder through said first lever.

* * * * *